US007452042B2

(12) United States Patent
Norigoe

(10) Patent No.: US 7,452,042 B2
(45) Date of Patent: Nov. 18, 2008

(54) INK JET HEAD DRIVING METHOD AND APPARATUS

(75) Inventor: Takashi Norigoe, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 368 days.

(21) Appl. No.: 11/311,683

(22) Filed: Dec. 19, 2005

(65) Prior Publication Data

US 2006/0284911 A1 Dec. 21, 2006

(51) Int. Cl.
*B41J 29/38* (2006.01)

(52) U.S. Cl. ..... 347/11; 347/10; 347/9; 347/14

(58) Field of Classification Search ..... 347/11, 347/14, 9, 57, 68, 74, 15, 10
See application file for complete search history.

(56) References Cited

U.S. PATENT DOCUMENTS 5,541,628 A 7/1996 Chang et al.
6,106,092 A 8/2000 Norigoe et al.
6,193,343 B1 2/2001 Norigoe et al.
6,409,295 B1 6/2002 Norigoe
6,431,674 B2 8/2002 Suzuki et al.
6,471,318 B2 * 10/2002 Fujii ..... 347/9
6,629,741 B1 * 10/2003 Okuda et al. ..... 347/11

FOREIGN PATENT DOCUMENTS

JP 2931817 B1 5/1999
JP 2000-177127 A 6/2000
JP 2001-146003 A 5/2001
JP 2003-1821 A 1/2003

* cited by examiner

*Primary Examiner*—Stephen D. Meier
*Assistant Examiner*—Rene Garcia, Jr.
(74) *Attorney, Agent, or Firm*—Frishauf, Holtz, Goodman & Chick, P.C.

(57) ABSTRACT

There is provided an ink jet head driving method for applying a drive pulse to an actuator to change capacities of a plurality of pressure chambers in which ink has been filled, ejecting an ink droplet from a nozzle formed in communication with the pressure chamber to print onto a printing medium, and moreover, continuously ejecting a plurality of liquid droplets to carry out gradation printing according to the number of liquid droplets, the method including making control so as to, in the case where the number of the liquid droplets is smaller than a predetermined number, apply a boost pulse to amplify a pressure vibration of the pressure chamber prior to a drive pulse for ejecting a first liquid droplet, and in the case where the number of liquid droplets is equal to or greater than the predetermined number, disable applying of the boost pulse.

6 Claims, 6 Drawing Sheets

INK JET HEAD DRIVING METHOD AND APPARATUS

CROSS-REFERENCE TO RELATED APPLICATIONS

This application is based upon and claims the benefit of priority from prior Japanese Patent Application No. 2005-176463, filed Jun. 16, 2005, the entire contents of which are incorporated herein by reference.

BACKGROUND OF THE INVENTION

1. Field of the Invention

The present invention relates to an ink jet head driving method and driving apparatus for changing the capacity of a pressure chamber in which ink has been filled by a piezoelectric element in response to a print signal, and then, ejecting an ink droplet from a nozzle which communicates with the pressure chamber by the resulting pressure change, thereby printing a character or an image and the like on a printing medium.

2. Description of the Related Art

A description will be given with a conventional print head with reference to FIG. 13. In FIG. 13, reference numeral 1 denotes an ink jet print head. This ink jet print head 1 is composed of: a plurality of pressure generating chambers in which ink is filled; a nozzle plate 11 provided at one end of each of these pressure generating chambers 17; a nozzle 15 for ejecting an ink droplet 19 formed in correspondence with each of the pressure generating chambers 17 on this nozzle plate 11; a piezoelectric actuator 14 provided in correspondence with each of the pressure generating chambers 17 to apply vibration to the pressure generating chambers 17 via a vibration plate 13, and then, eject ink from the nozzle 15 by a capacity change inside of the pressure generating chambers 17 due to the applying of this vibration; and an ink chamber 18 or the like provided in communication with each of the pressure generating chambers 17, the ink chamber being adopted to supply the ink to the pressure generating chamber 17 via an ink supply passage 16 from an ink tank not shown. With such a construction, when the piezoelectric actuator 14 is driven, a pressure vibration is applied to the pressure generating chamber 17, the capacity inside of the pressure generating chamber 17 is changed by this pressure vibration, and the ink droplet 19 is ejected from the nozzle 15. This ink droplet 19 is deposited onto a printing medium such as printing sheet of paper, and a dot is formed on the printing medium. By continuous forming of such dots, a predetermined character or image and the like based on image data is printed.

In general, in an ink jet printer, in the case where high quality printing is carried out, there is used an area gradation system such as a dither system, for forming one pixel by producing a matrix with a plurality of dots without changing the size of an ink droplet, and expressing gradation based on a difference in the number of dots in pixel. In this case, resolution must be sacrificed in order to allocate a certain number of gradations. In addition, there is provided a density gradation system for changing the density of one dot by varying the size of an ink droplet. In this case, although resolution is not sacrificed, there is a problem that a technique for controlling the size of an ink droplet is difficult.

Further, there is a so called multi-drop driving system for carrying out density gradation by varying the number of ink droplets to be printed with respect to one dot without changing the size of an ink droplet. In this case, resolution is not sacrificed, and there is no need to control the size of an ink droplet, thus making it possible to comparatively easily carry out this driving system.

A method for driving an ink jet head in a multi-drop system is also known (refer to Jpn. Pat. No. 2931817). Further, an ink jet type printing apparatus is known as reducing a cycle of a drive signal so as to speed up printing (refer to Jpn. Pat. Appln. KOKAI Publication No. 2001-146003). Furthermore, an ink jet printing apparatus for, when a repetition time for ejecting ink droplets variously changes, efficiently ejecting a predetermined amount of ink from an ejecting port is also known (refer to Jpn. Pat. Appln. KOKAI Publication No. 2000-177127).

In this multi-drop driving system, in the case where a plurality of liquid droplets are continuously ejected, an ejection speed of second and subsequent droplets can be increased more significantly than that in a first liquid droplet by using residual pressure vibration of the droplets just ejected before.

On the other hand, in general, the first liquid droplet becomes lower in ejection speed than the second and subsequent liquid droplets because a pressure vibration is applied in a state in which meniscus is stationary. Thus, there is a problem that ejection becomes unstable or print quality is degraded because of a small amount of ejection.

In order to avoid such a problem, there is an option for increasing an applied voltage, and then, increasing a pressure vibration entirely applied to a pressure chamber, thereby increasing a first-drop ejection speed. However, there is a problem that power consumption is increased, and a heating rate is increased by increasing a voltage. In addition, there is a problem that ejection becomes unstable because the ejection speed of the second and subsequent droplets becomes too high or print quality is degraded due to displacement in ink deposition between gradations, resulting from the increased difference in ejection speed of each droplet.

In addition, another method for avoiding a problem that an amount of ejection is small and print quality is degraded includes increasing a first-drop ejection speed by applying a fine pressure vibration to an extent that a liquid droplet is not ejected before a first-drop drive pulse (hereinafter, such a drive pulse is referred to as a boost pulse). This boost pulse is redundantly applied, whereby a time of an entire drive cycle is extended, and therefore, such an extended time is disadvantageous for high speed printing.

BRIEF SUMMARY OF THE INVENTION

It is an object of the present invention to provide an ink jet head driving method and driving apparatus which is capable of improving unstable ejection or degraded print quality in the case where the number of liquid droplets is small and which is capable of achieving printing at a high speed in the case where the number of liquid droplets is large.

According to one aspect of the present invention, there is provided an ink jet head driving method for applying a drive pulse to an actuator to change capacities of a plurality of pressure chambers in which ink has been filled, ejecting an ink droplet from a nozzle formed in communication with the pressure chamber to print onto a printing medium, and moreover, continuously ejecting a plurality of liquid droplets to carry out gradation printing according to the number of liquid droplets, the method comprising: making control so as to, in the case where the number of the liquid droplets is smaller than a predetermined number, apply a boost pulse to amplify a pressure vibration of the pressure chamber prior to a drive pulse for ejecting a first liquid droplet; and in the case where the number of liquid droplets is equal to or greater than the predetermined number, disable applying of the boost pulse.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
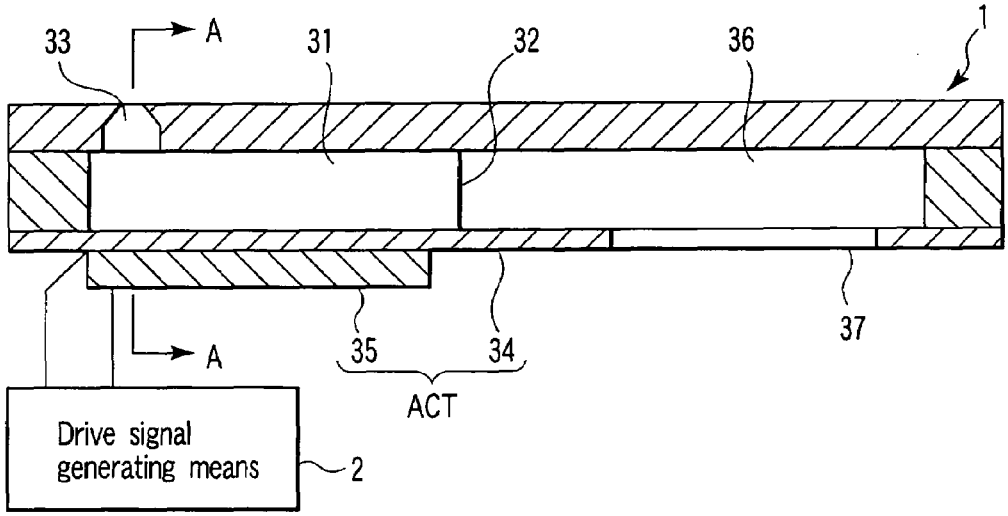
FIG. 1 is a view showing a construction of essential portions in an ink jet printing apparatus according to an embodiment of the present invention.
Figure 2:
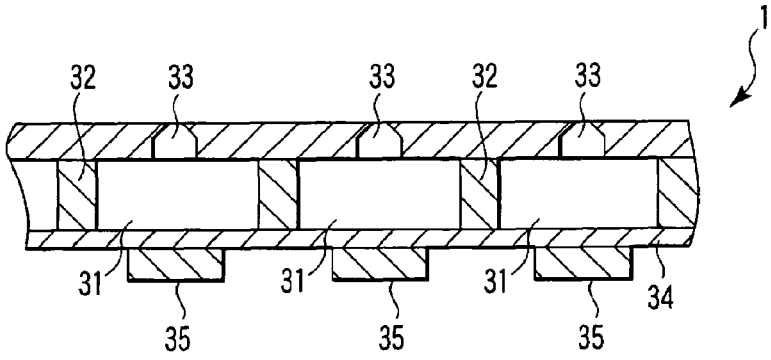
FIG. 2 is a sectional view taken along the line A-A of FIG. 1.

Hereinafter, an embodiment of the present invention will be described with reference to the accompanying drawings. FIGS. 1 and 2 are views each showing a construction of essential portions in an ink jet printing apparatus. FIG. 2 is a sectional view taken along the line A-A of FIG. 1.

In FIGS. 1 and 2, reference numeral 1 denotes an ink jet head; and reference numeral 2 denotes drive signal generating means. The ink jet head 1 is formed while a plurality of pressure chambers 31 housing ink is partitioned by a bulkhead 32, and nozzles 33 for ejecting ink droplets are provided in the pressure chamber 31, respectively. A bottom face of each of the pressure chambers 31 is formed of a vibration plate 34, and a plurality of piezoelectric members 35 is fixed in correspondence with each of the pressure chambers at the lower face side of the vibration plate 34. The vibration plate 34 and the piezoelectric member 35 constitute an actuator ACT, and the piezoelectric member is electrically connected to an output terminal of the drive signal generating means 2.

A common pressure chamber 36 communicating with each of the pressure chambers 31 is formed at the ink jet head 1. To this common pressure chamber 36, ink is injected from ink supply means (not shown) via an ink supply port 37 so as to fill the ink in the common pressure chamber 36, each pressure chamber 31, and nozzle 33. When the ink is filled in the pressure chamber 31 and the nozzle 33, whereby ink meniscus is formed in the nozzle 33.

Figure 3:
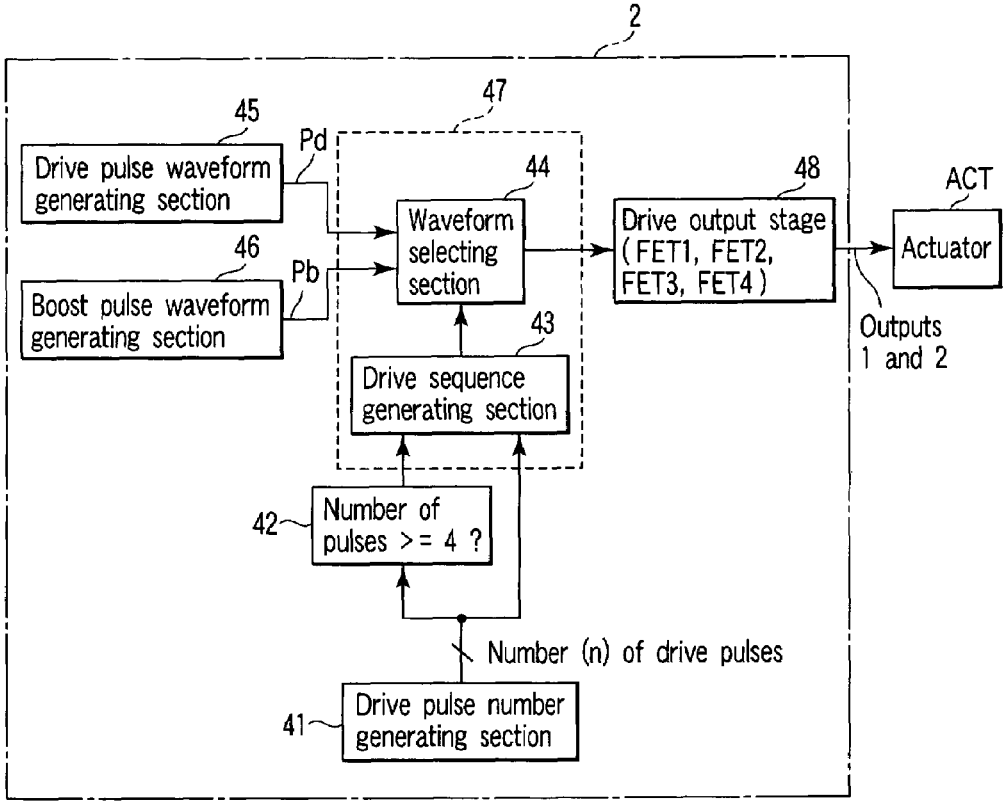
FIG. 3 is a view showing a detailed construction of drive signal generating means shown in FIG. 1.

Now, a detailed construction of the drive signal generating means 2 will be described with reference to FIG. 3. In FIG. 3, reference numeral 41 denotes a drive pulse number generating section by which the number "n" of drive pulses is generated. This drive pulse number generating section generates the number of drive pulses based on gradation data on print to be input to an ink jet printing apparatus. The number "n" of drive pulses corresponds to the number of liquid droplets.

The number "n" of drive pulses outputted from this drive pulse number generating section 41 is sent to a judging section 42, and it is judged that the number "n" of drive pulses is equal to or greater than a predetermined number N (for example, N=4).

Here, a value of a predetermined number N stored in advance in this judging section 42 is in the range of $1 \leqq N \leqq n$. This value can be arbitrarily changed externally from an operating panel of an ink jet printing apparatus or a controller or the like of a host computer.

A judgment result obtained by this judging section 42 is output to a drive sequence generating section 43. Here, the number "n" of drive pulses generated by the drive pulse number generating section 41 is also input to the drive pulse sequence generating section 43.

The drive sequence generating section 43 controls waveform selection at a waveform selecting section 44. To this waveform selecting section 44, there are input: a drive pulse Pd output from a drive pulse waveform generating section 45 (refer to FIG. 4); and a boost pulse Pb output from a boost pulse waveform generating section 46 (refer to FIG. 5), respectively. A waveform output section 47 is composed of the drive sequence generating section 43 and the waveform selecting section 44.

In the drive sequence generating section 43, in the case where the number "n" of drive pulses is smaller than a predetermined number N (for example, N=4), namely, the number 3 or less, the waveform output section 47 controls the waveform selecting section 44 so as to select and output the drive pulse Pd "n" times after the boost pulse Pb is selected once.

On the other hand, in the case where the number "n" of drive pulses is equal to or greater than a predetermined number N (for example, N=4), namely, the number is 4 or more, the drive sequence generating section 43 controls the waveform selecting section 44 so as to select and output the drive pulse Pd "n" times.

The waveform output from this waveform selector 44 is output to drive output means 48 described in detail with reference to FIG. 6. Then, an output 1 and an output 2 of this drive output means 48 are connected to an actuator ACT.

When the boost pulse Pb from the drive signal generating means 2 is applied to the piezoelectric member 35 of the actuator ACT, meniscus is vibrated to an extent that no ink droplet is ejected.

When the drive pulse Pd from the drive signal generating means 2 is applied to the piezoelectric member 35, this piezoelectric member 35 displaces the vibration plate 34 and changes the capacity of the pressure chamber 31, whereby a pressure wave is generated in the pressure chamber 31, and an ink droplet is ejected from the nozzle 33.

Figure 4:
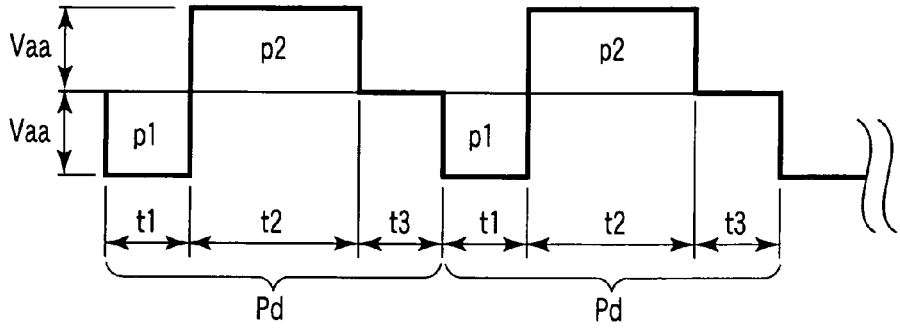
FIG. 4 is a waveform chart showing an example of a drive pulse generated by the drive signal generating means according to the embodiment.

Now, referring to FIG. 4, a description will be given with respect to a waveform chart of the drive pulse Pd generated from the drive signal generating means 2. This drive pulse Pd consists of: an expansion pulse p1 for expanding the capacity of the pressure chamber 31; a contraction pulse p2 for contracting the capacity of the pressure chamber 31; and a pause time t3. The expansion pulse p1 is produced as a rectangular wave having a voltage amplitude of −Vaa at a power conducting time of t1; and the contraction pulse p2 is produced as a rectangular wave having different polarities (+Vaa) at a voltage amplitude equal to the expansion pulse p1 when the power conducting time is t2.

In a multi-drop driving system, this drive pulse Pd is continuously generated by the number of liquid droplets to be ejected. In the present embodiment, all the drive pulses of each drop are formed in the same shape without being limited thereto.

Here, when a pressure propagation time is defined as Ta when a pressure wave in ink propagates the inside of the pressure chamber from a common pressure chamber at a rear end to a nozzle tip end, the power conducting time t1 of the expansion pulse p1 is set in the proximity of Ta; and the power conducting time t2 of the contraction pulse p2 is set in the range of 1.5 Ta to 2 Ta. In addition, the pause time t3 is set in the range of 0 to Ta.

Figure 6:
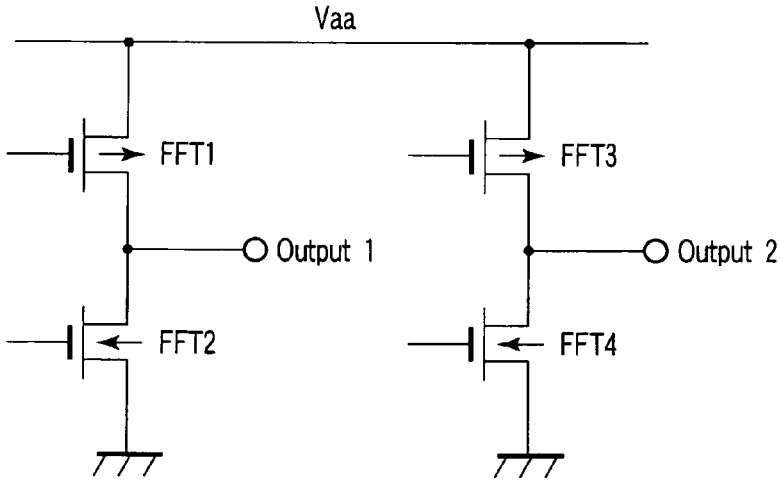
FIG. 6 is a view showing a part of a circuit which configures the drive signal generating means according to the embodiment.

FIG. 6 shows a part of a circuit of the drive signal generating means 2 shown in FIG. 1. There is employed a system for producing the expansion pulse p1 and the contraction pulse p2 by changing polarity at a single drive power source. As shown in FIG. 6, FET1 and FET2 serial circuits are connected between a Vaa power supply terminal and a grounding terminal. An output 1 from a connection point between these FET1 and FET2 is connected to one electrode terminal of the piezoelectric member 35. FET3 and FET4 serial circuits are connected between the other Vaa power supply terminal and a grounding terminal, and an output 2 from a connection point between these FET3 and FET4 is connected to the other electrode terminal of the piezoelectric member 35. In the case where the expansion pulse p1 shown in FIG. 4 is applied, FET1 is turned on, FET2 is turned off, FET3 is turned off, and FET4 is turned on. In the case where the contraction pulse 2 is applied, FET1 is turned off, FET2 is turned on, FET3 is turned on, and FET4 is turned off, thereby changing the polarity of a voltage applied to the piezoelectric member.

Figure 7:
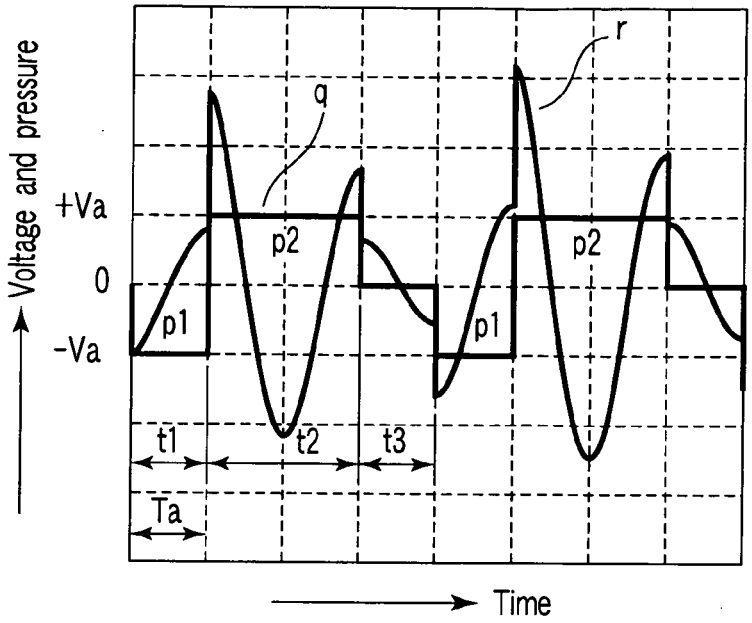
FIG. 7 is a view showing the drive pulse and an ink pressure change in a pressure chamber according to the embodiment.

Now, referring to FIG. 7, a description will be given with respect to a power conducting waveform "q" applied to the pressure chamber 31 in the case where the drive pulse Pd has been applied and a pressure vibration waveform "r" generated in the pressure chamber 31. In the figure, the power conducting time t1 of the expansion pulse p1 is set to time Ta required for the pressure wave generated in the pressure chamber 31 to propagate from one end to the other end of the pressure chamber 31; the power conducting time t2 of the contraction pulse p2 is set to 2 Ta which is twice the time Ta; and the pause time t3 is also set to Ta.

First, when a voltage −Vaa is applied between electrodes of the piezoelectric member 35, the piezoelectric member 35 is deformed so as to rapidly increase the capacity of the pressure chamber 31 so that a negative pressure is momentarily generated in the pressure chamber 31. This pressure is inverted to a positive pressure when a pressure propagation time Ta has elapsed.

Next, when a voltage +Vaa having opposite polarity is applied between electrodes of the piezoelectric member 35, the piezoelectric member 35 is deformed so as to rapidly contract the capacity of the pressure chamber 31 from the expanded state, whereby a positive pressure is momentarily generated in the pressure chamber 31. The pressure wave generated by this pressure coincides with a first generated pressure wave in phase so that the amplitude of the pressure wave is rapidly increased. At this time, an ink droplet is ejected from a nozzle.

Then, when the time 2 Ta which is twice the pressure propagation time has elapsed, the pressure in the pressure chamber 31 changes in a direction from positive to negative, and then, positive. At this time, the voltage between the electrodes of the piezoelectric member 35 is reset to zero, whereby the contracted capacity of the pressure chamber reverts to its original state, and the pressure in the pressure chamber 31 momentarily decreases. Thus, the amplitude of the pressure wave is weakened, and then, the residual pressure vibration decreases.

Further, when the pause time Ta has elapsed the pressure vibration during this period changes in a direction from positive to negative. At this time, when the second-drop expansion pulse p1 is continuously applied, the capacity of the pressure chamber 31 is rapidly increased again, and a negative pressure is momentarily applied again in the pressure chamber 31. At this time, the next pressure vibration is applied in a state in which the residual pressure vibration of the first drop still remains. Thus, the pressure in the pressure chamber 31 is obtained as a negative pressure which is greater than the case of the first drop.

Therefore, when the next pressure propagation time Ta has elapsed, the inverted positive pressure also increases. Further, the contraction pulse p2 is applied, whereby a pressure required for-the second-drop ejection becomes greater than that required for the first-drop. Here, the pause time t3 is set to a proper time, whereby a value of the residual vibration can be changed. An ejection speed can be increased or decreased by increasing the pressures required for the second-drop ejection more significantly than the first-drop.

In general, a drive voltage can be reduced more significantly, enabling efficient driving by making control such that the second-drop pressure is increased more significantly than the first-drop pressure.

Figure 5:
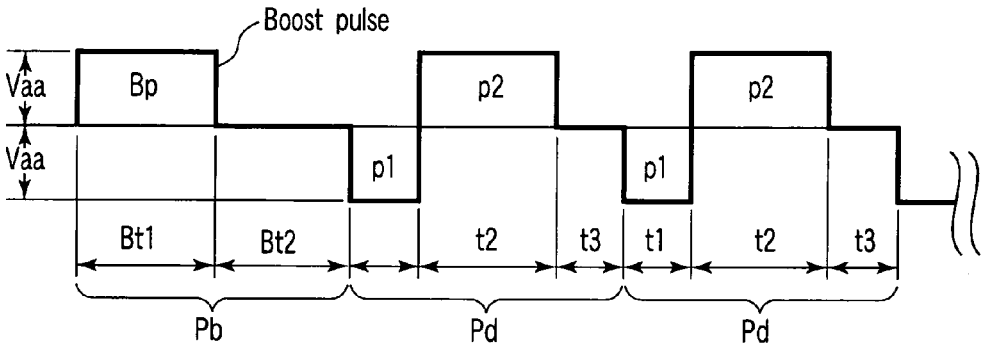
FIG. 5 is a waveform chart showing an example of a boost pulse and a drive pulse generated by the drive signal generating means according to the embodiment.

Now, referring to FIG. 5, a description will be given with respect to a waveform obtained by adding the boost pulse Pb prior to the first-drop drive pulse Pd.

The boost pulse Pb consists of a contraction pulse Bp for contracting the capacity of the pressure chamber 31 and a pause time Bt2, and the contraction pulse Bp is produced as a rectangular wave having a voltage amplitude of +Vaa when a power conducting time is Bt1. The succeeding first drop and subsequent pulses Pd are identical to those shown in FIG. 4.

In addition, when the pressure propagation time is set to Ta, the power conducting time Bt1 of the contraction pulse Bp is set to 2 Ta, and the pause time Bt2 is set in the order of 2 Ta.

In the present embodiment, although the form of the boost pulse Pb has the contraction pulse Bp and the pause time Bt2, the contraction pulse may be an expansion pulse and the pause time may be eliminated without being limited thereto.

Figure 8:
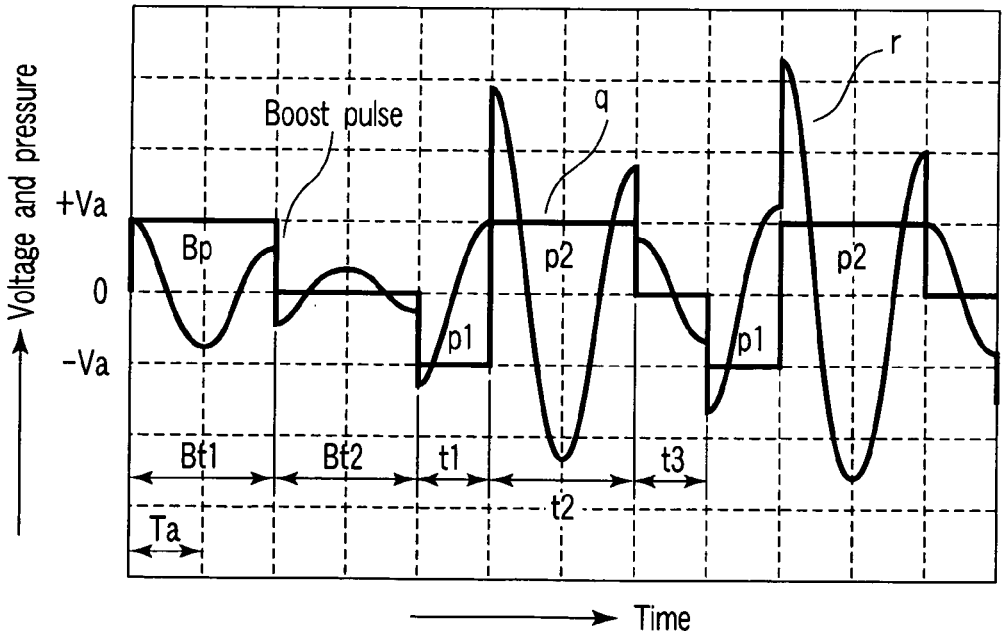
FIG. 8 is a view showing the boost pulse, drive pulse, and ink pressure change in the pressure chamber according to the embodiment.

Now, referring to FIG. 8, a description will be given with respect to a power conducting waveform "q" in the case where the boost pulse Pb shown in FIG. 5 has been applied and a pressure vibration waveform "r" generated in the pressure chamber 31. In the figure, the power conducting time Bt1 of the contraction pulse Bp of the boost pulse Pb is set to 2 Ta which is twice the pressure propagation time; the pause time Bt2 is also set to 2 Ta; and the power conducting time of the drive pulse Pd is identical to that shown in FIG. 7.

When a voltage +Vaa is applied between the electrodes of the piezoelectric member 35 by means of the boost pulse Pb, the piezoelectric member 35 is deformed so as to rapidly contract the capacity of the pressure chamber 31. Thus, a positive pressure is momentarily generated in the pressure chamber. This pressure changes in a direction from positive to negative, and then, to positive while a time 2 Ta has elapsed. Next, the voltage between the electrodes of the piezoelectric member 35 is reset to zero, whereby the capacity of the pressure chamber 31 reverts to its original state rapidly. Thus, the pressure in the pressure chamber is momentarily inverted in phase from positive to negative.

Then, while the pause time 2 Ta has elapsed, the pressure changes in a direction from negative to positive, and then, to negative in turn. When a voltage −Vaa is applied between the electrodes of the piezoelectric member 35 by means of the first-drop expansion pulse p1, the piezoelectric member 35 is deformed so as to rapidly increase the capacity of the pressure chamber 31. Thus, a negative pressure is momentarily applied to the inside of the pressure chamber 31.

At this time, the residual pressure vibration caused by the boost pulse Pb still remains in the pressure chamber 31, and thus, greater pressure amplitude is produced as compared with a case in which no boost pulse Pb is applied. Therefore, when next pressure propagation time Ta has elapsed, the inverted positive pressure also increases. Further, a voltage +Vaa is applied between the electrodes of the piezoelectric member 35 by means of the contraction pulse p2, and the piezoelectric member 35 is deformed so as to rapidly contract the capacity of the pressure chamber 31 from its expanded state, whereby a positive pressure is momentarily applied in the pressure chamber 31. Further, the pressure amplitude increases more significantly than a case in which no boost pulse Pb is applied. The boost pulse Pb is thus applied, whereby a pressure required for the first-drop ejection can be increased by the residual pressure vibration.

Figure 9:
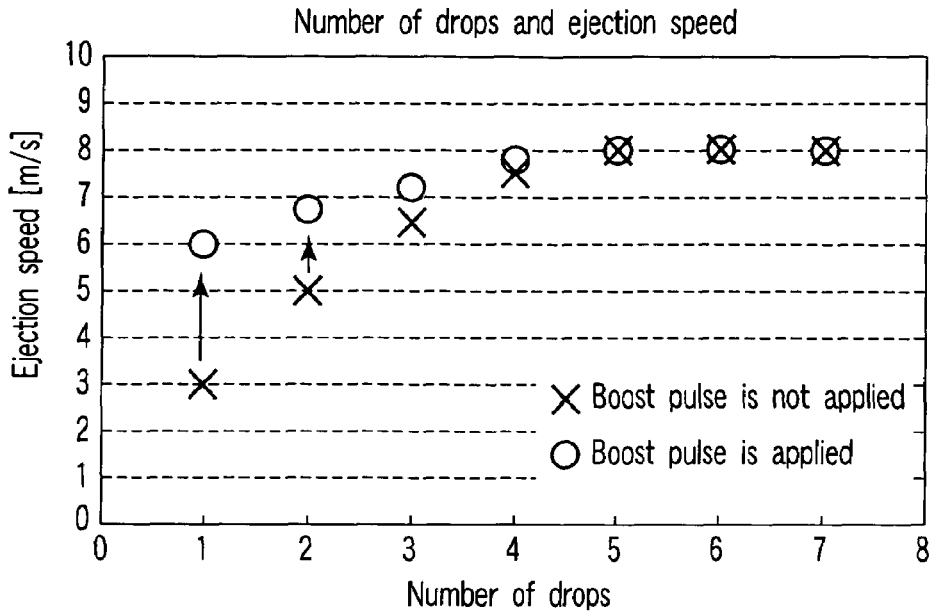
FIG. 9 is a graph depicting a relationship between the number of drops and an ejection speed in a conventional technique.

FIG. 9 shows advantageous effect of the boost pulse Pb. This figure also shows a relationship between the number of drops and ejection speed in the case where the boost pulse Pb is applied or not prior to the first-drop drive pulse Pd in a 7-drop, 8-gradation multi-drop driving system.

As shown in FIG. 9, in the case where no boost pulse Pb is applied, the ejection speed in the first one to three drops for which the predetermined number N (for example, N=4) is smaller than 4 is lowered. However, the ejection speed can be increased by applying the boost pulse Pb. In addition, the ejection speed of the fourth drop which is the predetermined number N and subsequent drops is almost kept unchanged whether the boost pulse Pb is applied or not. Although the boost pulse Pb has an effect on the first several drops, it is found that this pulse hardly has an effect on the drops having the predetermined number N=4 and subsequent. As described above, with respect to the predetermined number N, an ink ejection speed from the nozzle is measured in both cases in which the boost pulse is applied and not applied for the number of liquid droplets, and the number of liquid droplets is set as a predetermined number when a difference between the ejection speed hardly occurs, whereby the boost pulse is applied to only the number of liquid droplets when the boost pulse is effective.

In the meantime, in the case where the number "n" of drive pulses is smaller than a predetermined number N (n<N), namely, the number is 3 or less, the drive signal generating means 2 selects the boost pulse Pb one time, and then, outputs the drive pulse Pd to the actuator ACT by "n" times.

On the other hand, in the case where the number "n" of drive pulses is equal to or greater than a predetermined number N (n≧N), namely, the number is 4 or more, the drive signal generating means 2 selects and outputs the drive pulse Pd to the actuator ACT by "n" times.

Figure 10:
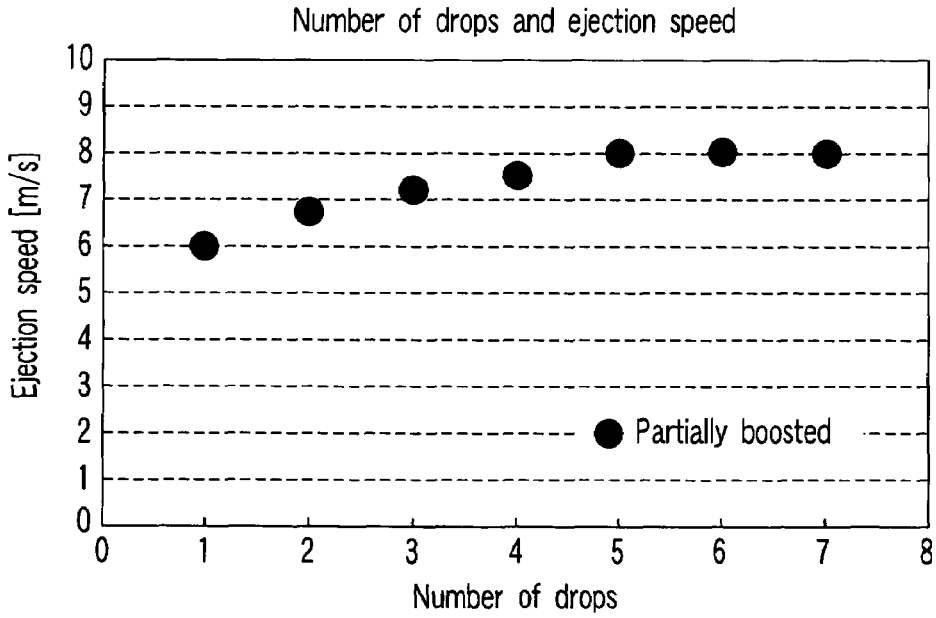
FIG. 10 is a graph depicting a relationship between the number of drops and an ejection speed in an embodiment of the present invention.

In one to three drops in which the number of liquid droplets is smaller than the predetermined number N=4, the boost pulse Pb is applied prior to the drive pulse Pd. In four to seventh drops in which the number of liquid droplets is equal to or greater than the predetermined number N=4, a relationship between the number of drops and an ejection speed in the case where no boost pulse Pb is applied is obtained as shown in FIG. 10. This result is almost identical to those obtained in the case of the present invention shown in FIG. 10 and in the case where the boost pulse is applied as shown in FIG. 9.

Figure 11:
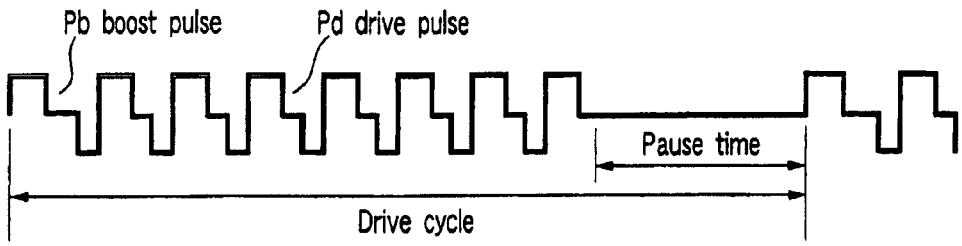
FIG. 11 is a waveform chart of a drive pulse in a conventional driving method.

FIG. 11 shows a conventional drive waveform in the case where a maximum number of liquid droplets is 7 drops, and the boost pulse Pb has been applied prior to the first-drop drive pulse Pd. In this case, the drive cycle is a time obtained by adding a pause time for attenuating the boost pulse Pb, a drive pulse Pd for 7 drops, and the residual vibration.

Figure 12A:
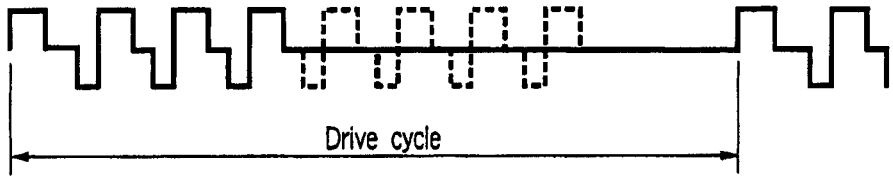
FIG. 12A is a waveform chart of a drive pulse in a driving method according to the present invention.
Figure 12B:
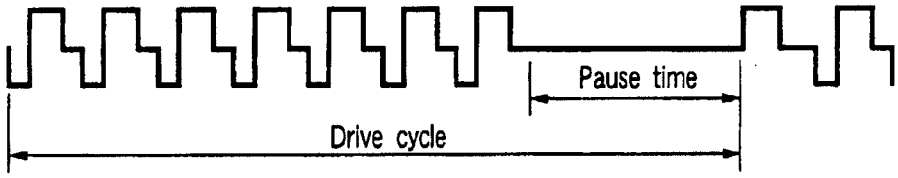
FIG. 12B is a waveform chart of a drive pulse in the driving method according to the present invention.
Figure 13:
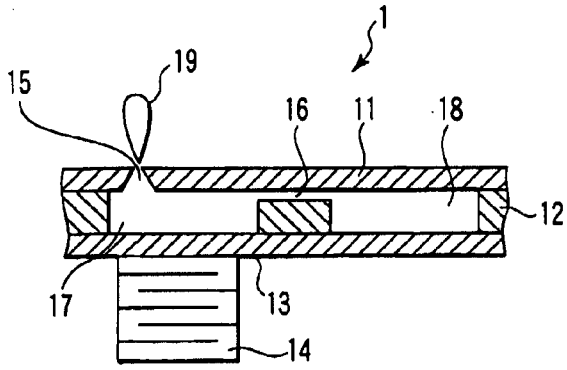
FIG. 13 PRIOR ART
FIG. 13 is a schematic cross-sectional view of an ink jet driving head according to the conventional technique.

FIGS. 12A and 12B relate to the present embodiment, wherein, in the case where the number of liquid droplets are smaller than a predetermined number N=4, the boost pulse Pb is applied, and, in the case where the number of liquid droplets is equal to or greater than the predetermined number N=4, no boost pulse Pb is applied.

FIG. 12A shows a drive waveform in n=3 drops when the number of liquid droplets is smaller than a predetermined number N=4. In this case, the boost pulse Pb is applied.

FIG. 12B shows a drive waveform in n=7 drops which is a maximum number of liquid droplets. In this case, no boost pulse Pb is applied, and thus, the drive cycle is a time obtained by adding the drive pulse Pd for 7 drops and the pause time, and the drive cycle time can be reduced by the absence of the boost pulse Pb.

In the present embodiment, the maximum number of liquid drops is 7, and the predetermined number is set to N=4, whereby one to three drops have been set to apply the boost pulse Pb. However, the present invention is not limited to this embodiment.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink jet head driving method for applying a drive pulse to an actuator to change capacities of a plurality of pressure chambers in which ink has been filled, ejecting an ink droplet from a nozzle formed in communication with the pressure chamber to print onto a printing medium, and moreover, continuously ejecting a plurality of liquid droplets to carry out gradation printing according to the number of liquid droplets, the method comprising:

making control so as to, in the case where the number of the liquid droplets is smaller than a predetermined number, apply a boost pulse to amplify a pressure vibration of the pressure chamber prior to a drive pulse for ejecting a first liquid droplet; and in the case where the number of liquid droplets is equal to or greater than the predetermined number, disable applying of the boost pulse.

2. The ink jet head driving method according to claim 1, wherein an ejection speed of ink from the nozzle in the case where no boost pulse is applied for the number of liquid droplets and the ejection speed in the case where the boost pulse is applied are measured, and the number of liquid droplets when a difference therebetween hardly occurs is set as the predetermined number.

3. An ink jet head driving apparatus comprising:

a plurality of pressure chambers in which ink has been filled;

an ink jet head which applies a drive pulse to an actuator to change the capacity of each of the pressure chambers, ejects an ink droplet from a nozzle formed in communication with the pressure chamber to carry out printing onto a printing medium, and moreover, continuously ejects a plurality of liquid droplets to carry out gradation printing according to the number of liquid droplets, and drive signal generating section configured, in the case where the number of the liquid droplets is smaller than a predetermined number, to apply a boost pulse to amplify a pressure vibration of the pressure chamber prior to a drive pulse for ejecting a first liquid droplet; and in the case where the number of liquid droplets is equal to or greater than the predetermined number, to disable applying of the boost pulse.

4. The ink jet head driving apparatus according to claim 3, wherein an ejection speed of ink from the nozzle in the case where no boost pulse is applied for the number of liquid droplets and the ejection speed in the case where the boost pulse is applied are measured, and the number of liquid droplets when a difference therebetween hardly occurs is set as the predetermined number.

5. An ink jet head driving apparatus comprising:

a plurality of pressure chambers in which ink has been filled;

an ink jet head which applies a drive pulse to an actuator to change the capacity of each of the pressure chambers, ejects an ink droplet from a nozzle formed in communication with the pressure chamber to carry out printing onto a printing medium, and moreover, continuously ejects a plurality of liquid droplets to carry out gradation printing according to the number of liquid droplets, drive pulse number generating section configured to generate the number of the drive pulses;

judging section configured to judge whether or not the number of drive pulses generated from the drive pulse number generating section is equal to or greater than a predetermined number which has been stored in advance;

pulse applying section configured, in the case where it has been judged that the number of drive pulses is smaller than the predetermined number by the judging means, to apply a drive pulse that follows a boost pulse to the actuator by the number of drive pulses, and, in the case where it has been judged that the number of drive pulses is equal to or greater than the predetermined number by the judging means, to apply a drive pulse to the actuator by the number of drive pulses.

6. The inkjet head driving apparatus according to claim 5, wherein the predetermined number stored in advance in the judging section can be externally changed.

* * * * *